US011247361B2

(12) United States Patent
Jan

(10) Patent No.: US 11,247,361 B2
(45) Date of Patent: Feb. 15, 2022

(54) ADJUSTABLE TRIMMING MECHANISM

(71) Applicant: OAV EQUIPMENT AND TOOLS, INC., Taichung (TW)

(72) Inventor: Long-Chang Jan, Taichung (TW)

(73) Assignee: OAV EQUIPMENT AND TOOLS, INC., Taichung (TW)

( * ) Notice: Subject to any disclaimer, the term of this patent is extended or adjusted under 35 U.S.C. 154(b) by 124 days.

(21) Appl. No.: 16/688,461

(22) Filed: Nov. 19, 2019

(65) Prior Publication Data

US 2021/0146567 A1 May 20, 2021

(51) Int. Cl.

| | |
|---|---|
| ***B26D 7/01*** | (2006.01) |
| ***B26D 3/06*** | (2006.01) |
| ***B26D 3/10*** | (2006.01) |

(52) U.S. Cl.

CPC ..... *B26D 7/01* (2013.01); *B26D 3/06* (2013.01); *B26D 3/10* (2013.01)

(58) Field of Classification Search

CPC ... B26D 3/06; B26D 3/10; B26D 7/01; B26D 7/2628; B23D 35/005; B23Q 9/0042; Y10T 83/68

See application file for complete search history.

(56) References Cited

U.S. PATENT DOCUMENTS

| | | | | |
|---|---|---|---|---|
| 4,222,812 | A * | 9/1980 | Duewel | B27D 5/003 156/497 |
| 5,660,094 | A * | 8/1997 | Sasaki | B23D 45/044 83/471.3 |
| 6,467,522 | B1 * | 10/2002 | Durney | B26D 1/205 156/355 |
| 8,707,839 | B2 * | 4/2014 | Opsitos, Jr | B23D 47/04 83/445 |
| 10,124,536 | B1 * | 11/2018 | Jan | B29C 66/80 |

* cited by examiner

*Primary Examiner* — Stephen Choi
(74) *Attorney, Agent, or Firm* — Muncy, Geissler, Olds & Lowe, P.C.

(57) ABSTRACT

An adjustable trimming mechanism includes a wheel module having a wheel mount and a wheel disposed on the wheel mount, and a motor module having a motor mount, a slide rail disposed on a side of the motor mount, a motor, a slider disposed on the slide rail and connected with the motor, a pull rod and a positioning member threadedly disposed on the slide rail. One of the motor and wheel mounts is located above the other. An end of the slider is connected with the pull rod so that the slider drives the motor to displace together frontward or backward when being pulled by the pull rod. Therefore, when the positioning member is loosened, the position of the motor is adjustable frontward or backward by the cooperation of the pull rod and the slider and thereby the cutter installed on the motor is adjusted simultaneously.

11 Claims, 11 Drawing Sheets

ADJUSTABLE TRIMMING MECHANISM

BACKGROUND OF THE INVENTION

1. Field of the Invention

The present invention relates to banding machines and more particularly, to an adjustable trimming mechanism for a banding machine.

2. Description of the Related Art

A banding machine is a woodworking machine for gluing edge bands to edges of a wood plank. The banding process includes a plurality of steps of conveying, glue applying, cutting and pressing performed in order, and the last step is trimming the edges of the wood plank by a cutter. However, in the traditional design, the position of the aforementioned cutter is not adjustable, resulting in invariable trimming angle. Therefore, it can't be used for the demand for exceptional angle, resulting in operational perplexity and inconvenience and significant reduction in economic benefits.

SUMMARY OF THE INVENTION

It is a primary objective of the present invention to provide an adjustable trimming mechanism which enables the position of the cutter to be adjusted according to the practical demands, thereby increased in usage convenience and raised in economic benefits.

To attain the above objective, the present invention provides an adjustable trimming mechanism which includes a wheel module and a motor module. The wheel module has a wheel mount and a wheel disposed on the wheel mount. The motor module has a motor mount, a slide rail, a motor, a slider, a pull rod and a positioning member. The motor mount and the wheel mount are disposed in a way that one of them is located above the other of them, thereby saving space for transverse arrangement. The slide rail is disposed on a side of the motor mount and has a positioning threaded hole. The motor is located on the back of the wheel for providing power to a cutter, and a side of the motor is connected with the slider so that the motor is movable along with the slider. The slider is disposed on the slide rail in a way that the slider is horizontally displaceable relative to the slide rail, and an end of the slider is connected with the pull rod in a way that the slider is capable of being pulled by the pull rod to drive the motor to horizontally displace relative to the wheel. The positioning member has a handle and a positioning screw connected with the handle. The positioning screw is disposed in the positioning threaded hole of the slide rail in a way that the positioning screw is capable of being driven by the handle to make another end of the positioning screw abutted against the slider and thereby positioning the slider.

It can be known from the above description that when the positioning member is loosened, the position of the motor is adjustable frontward and backward by the cooperation of the pull rod and the slider and thereby the cutter installed on the motor is adjusted simultaneously. After the adjustment, the positioning member can be tightened, thereby positioning the slider. In other words, the adjustable trimming mechanism of the present invention enables the position of the cutter to be adjusted according to the practical demands, thereby attaining the objectives of increasing usage convenience and raising economic benefits.

Preferably, the wheel mount has a vertical through hole; the motor mount has an adjusting threaded hole; a vertically adjusting screw is inserted through the vertical through hole of the wheel mount; a knob is connected to an end of the vertically adjusting screw; another end of the vertically adjusting screw is screwed into the adjusting threaded hole of the motor mount. In this way, the motor mount is capable of being driven by the vertically adjusting screw to displace upwardly or downwardly relative to the wheel mount, so that the distance between the motor mount and the wheel mount is adjustable.

Preferably, two vertical guiding rods are disposed by two opposite sides of the vertically adjusting screw respectively; the two vertical guiding rods penetrate through the motor mount and the wheel mount in a way that the motor mount is displaceable along the axes of the vertical guiding rods. Besides, an end of the two vertical guiding rods is connected to a guiding seat; the guiding seat is disposed on two horizontal guiding rods in a way that the guiding seat is horizontally displaceable relative to the two horizontal guiding rods; two ends of the two horizontal guiding rods are fixed to a front end seat and a rear end seat respectively; the front end seat and the wheel are disposed in a way that one of them is located below the other of them. In this way, when the positioning member is tightened, the wheel module and the motor module are displaceable together along the axes of the two horizontal guiding rods by being driven by the guiding seat through the two vertical guiding rods, so that the positions of the wheel and the cutter are adjustable together frontward and backward.

Preferably, the motor mount has an accommodating trough; a supporting seat is disposed between the motor mount and the slide rail; the supporting seat has an arc groove; the slide rail has a lateral threaded hole. The present invention further provides an angle adjusting screw and a bushing. The angle adjusting screw has a head portion and a body portion connected with the head portion. The head portion is located in the accommodating trough. The body portion is inserted through the arc groove and an end of the body portion is screwed into the lateral threaded hole. The bushing is sleeved onto the body portion of the angle adjusting screw. An end of the bushing is abutted against the head portion of the angle adjusting screw. Another end of the bushing is abutted against a side of the supporting seat facing toward the motor mount. In this way, when the angle adjusting screw is loosened, the motor module, the angle adjusting screw and the bushing are movable together along the arc groove, so that the angle of the cutter is adjustable.

Preferably, the supporting seat is provided on a side thereof facing toward the slide rail with an arc guiding recess; the slide rail is provided on a side thereof facing toward the supporting seat with an arc guiding protrusion; the arc guiding protrusion of the slide rail is displaceably embedded in the arc guiding recess of the supporting seat, thereby increasing the stability of the movement of the slide rail.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

DETAILED DESCRIPTION OF THE INVENTION

Figure 1:
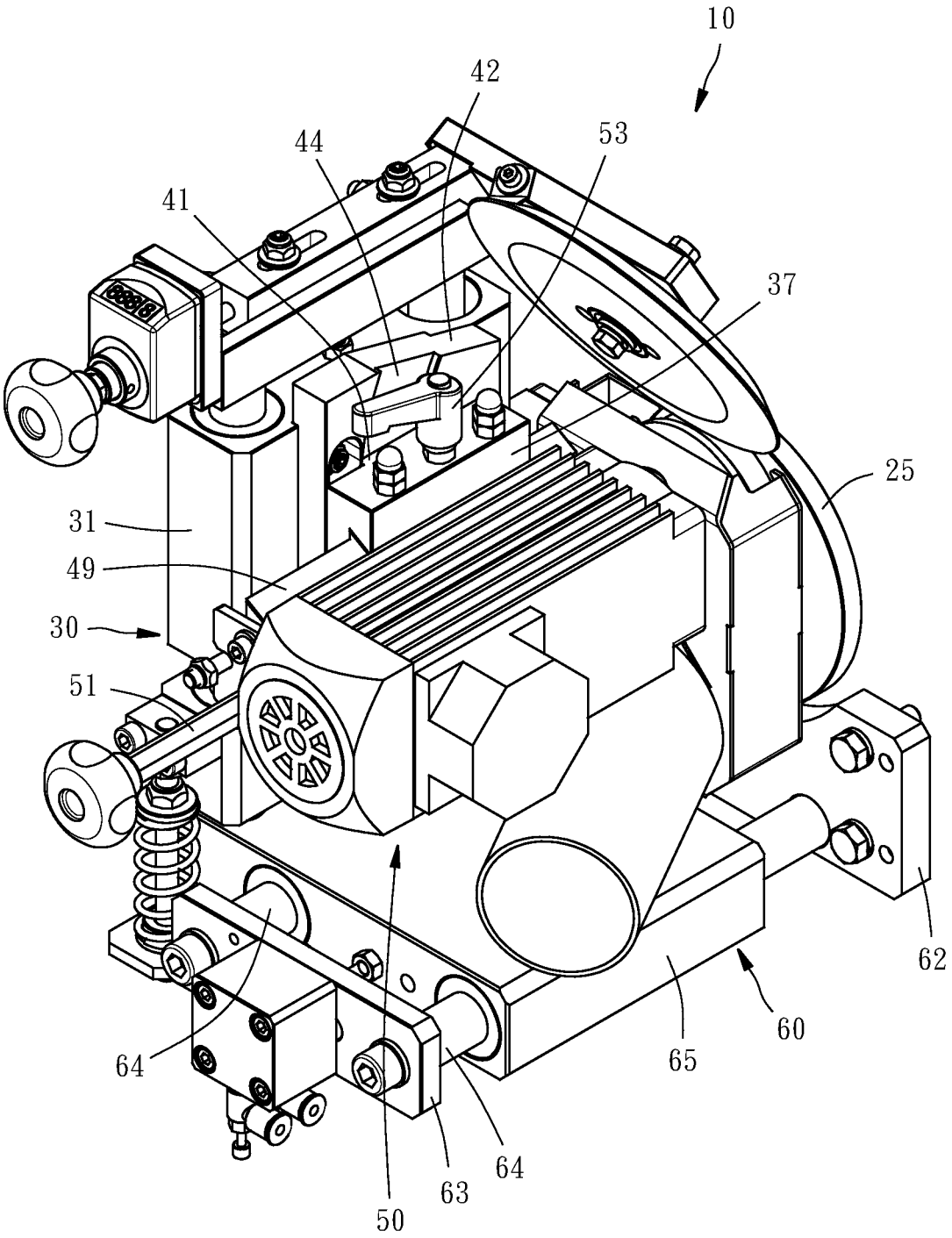
FIG. 1 is a perspective view of an adjustable trimming mechanism of the present invention.

First of all, it is to be mentioned that throughout this specification, including the following embodiments and claims, the directional terms are all based on the direction shown in the figures. Besides, same reference numerals used in the following embodiments and the appendix drawings designate same or similar elements or the structural features thereof.

Figure 2:
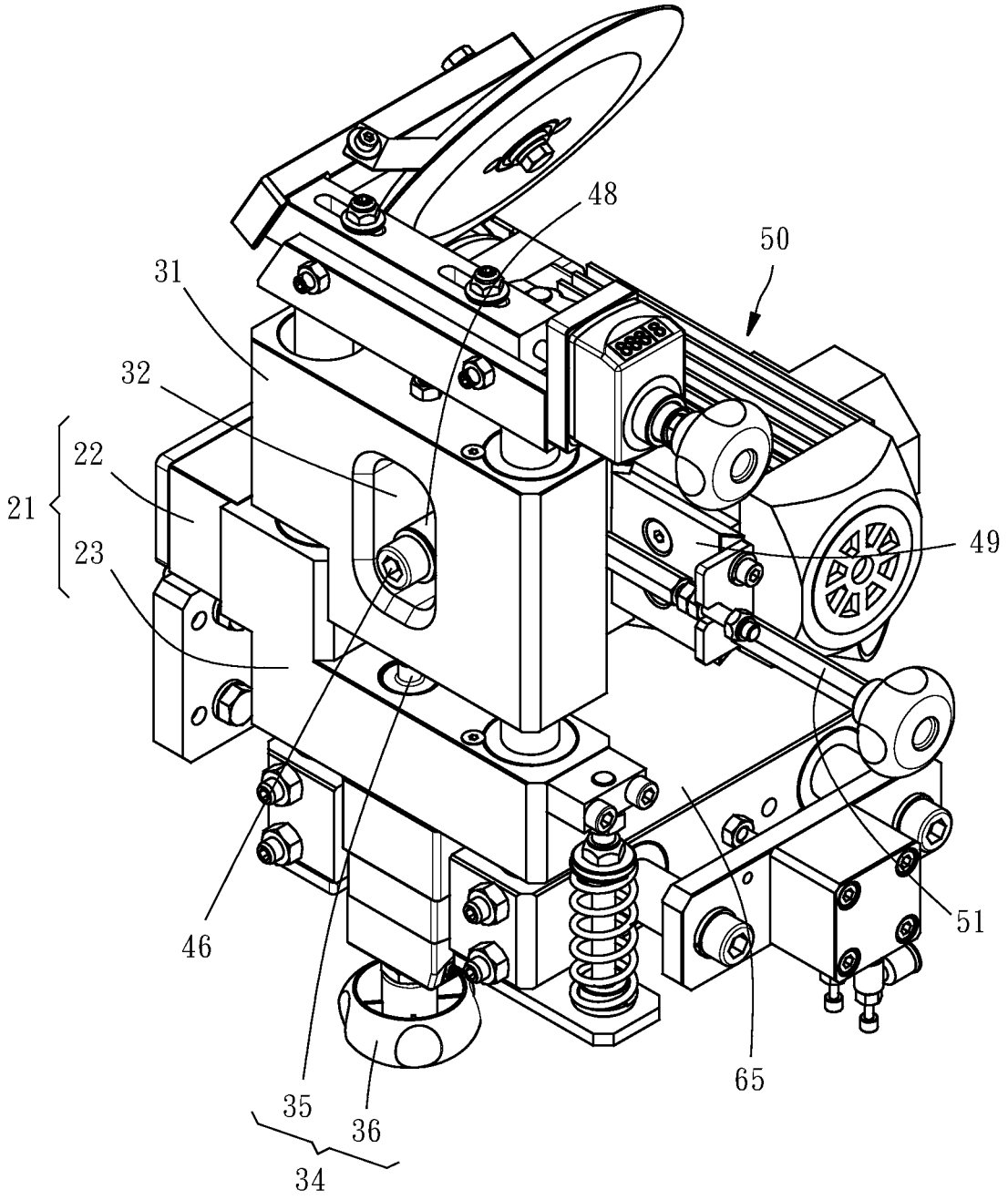
FIG. 2 is another perspective view of the adjustable trimming mechanism of the present invention, which is different from FIG. 1 in angle of view.
Figure 4:
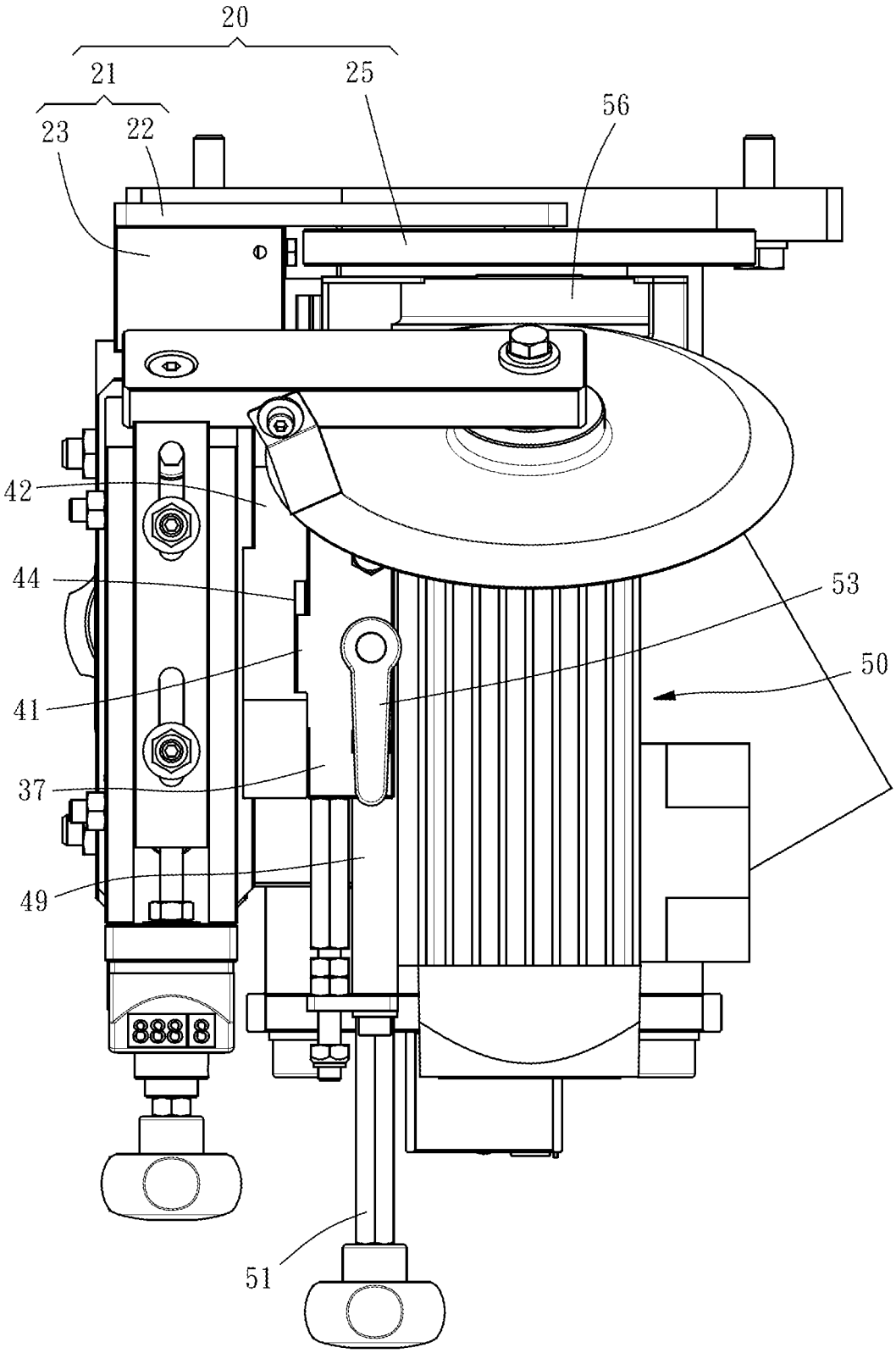
FIG. 4 is a top view of the adjustable trimming mechanism of the present invention.

Referring to FIGS. 1, 2 and 4, an adjustable trimming mechanism 10 of the present invention includes a wheel module 20 and a motor module 30.

Figure 11:
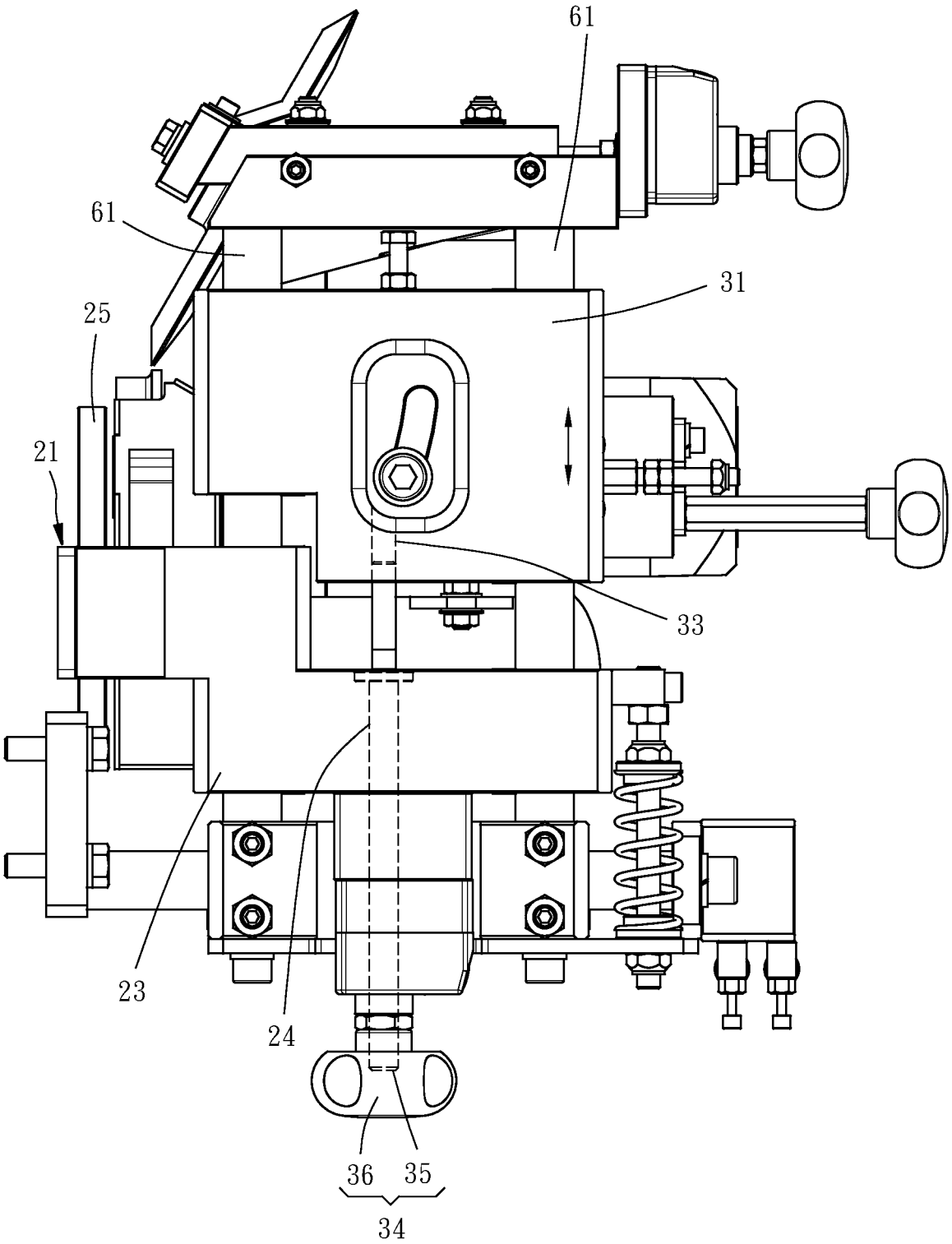
FIG. 11 is similar to FIG. 6, primarily showing the condition that a motor mount is displaceable upwardly and downwardly relative to a wheel mount.

The wheel module 20 has a wheel mount 21 and a wheel 25. The amount of the wheel can be increased to two or more than two, depending on the practical demands. The wheel mount 21 has a front plate 22 and a left plate 23. The left end of the front plate 22 and the front end of the left plate 23 are connected with each other in a perpendicular manner. The left plate 23 has a vertical through hole 24 penetrating through the top and bottom surfaces of the left plate, as shown in FIG. 11. The wheel 25 is installed on the front plate 22 of the wheel mount 21 in a way that the wheel 25 is rotatable without displacing, as shown in FIG. 4.

The motor module 30 has a motor mount 31, a slide rail 37, a slider 49, a motor 50, a pull rod 51 and a positioning member 52.

The motor mount 31 is provided at the center thereof with an accommodating trough 32 penetrating through the left and right sides of the motor mount. The motor mount 31 is provided on the bottom surface thereof with an adjusting threaded hole 33, as shown in FIG. 11. For saving space in transverse arrangement, the motor mount 31 and the left plate 23 of the wheel mount 21 are disposed in a way that one of them is located above the other of them. In this embodiment, the motor mount 31 is located above the left plate 23 of the wheel mount 21. Besides, as shown in FIG. 11, a vertically adjusting member 34 is disposed between the motor mount 31 and the wheel mount 21. The vertically adjusting member 34 has a vertically adjusting screw 35 and a knob 36. The vertically adjusting screw 35 is inserted through the vertical through hole 24 of the left plate 23 of the wheel mount 21 in a way that the vertically adjusting screw is rotatable without displacing and the top end of the vertically adjusting screw is screwed into the adjusting threaded hole 33 of the motor mount 31. The knob 36 is connected to the bottom end of the vertically adjusting screw 35 and located below the wheel mount 21. In this way, the motor mount 31 can be driven by the vertically adjusting screw 35 to displace upwardly or downwardly relative to the wheel mount 21, so that the distance between the motor mount and the wheel mount is adjustable.

Figure 3:
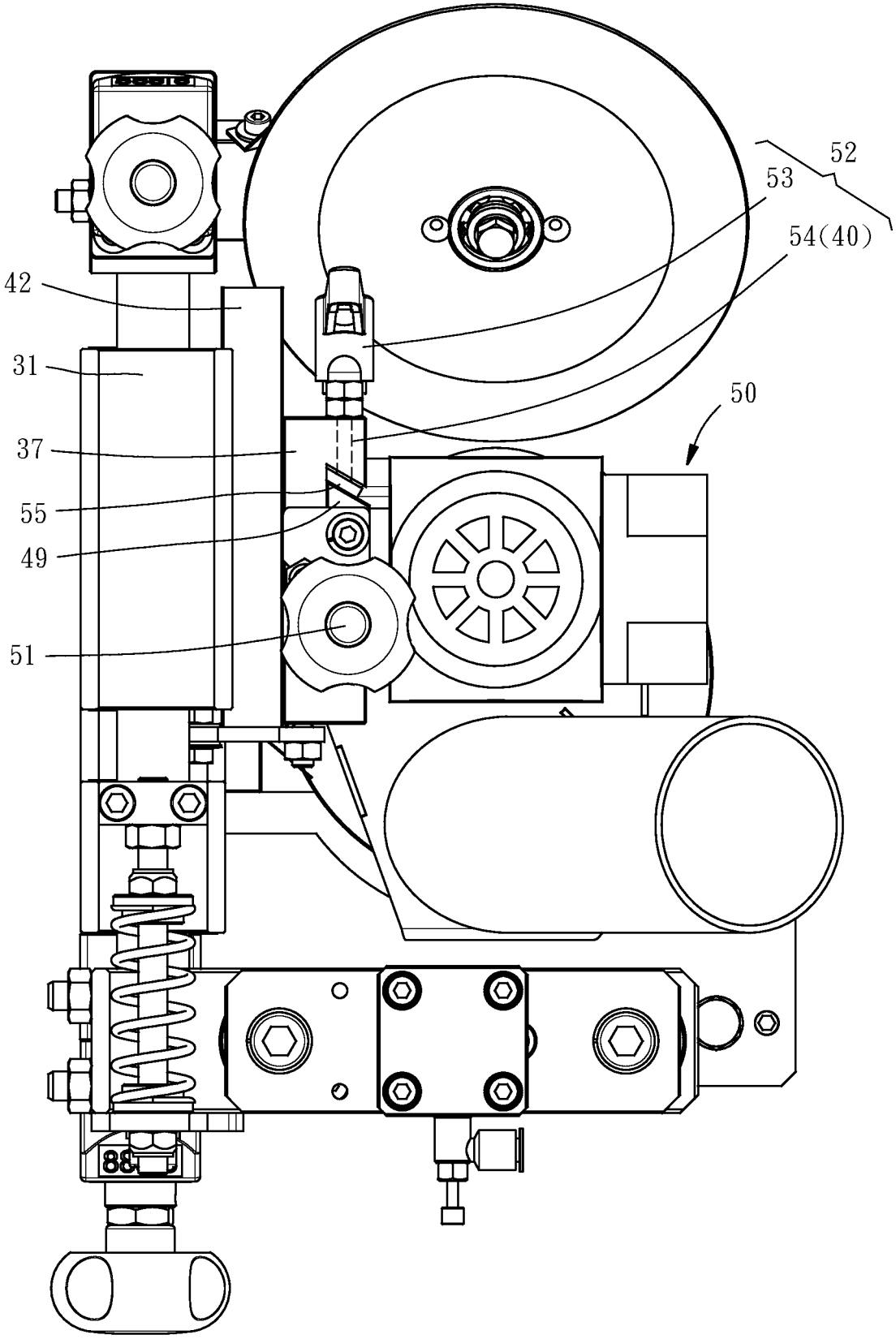
FIG. 3 is a front view of the adjustable trimming mechanism of the present invention.
Figure 6:
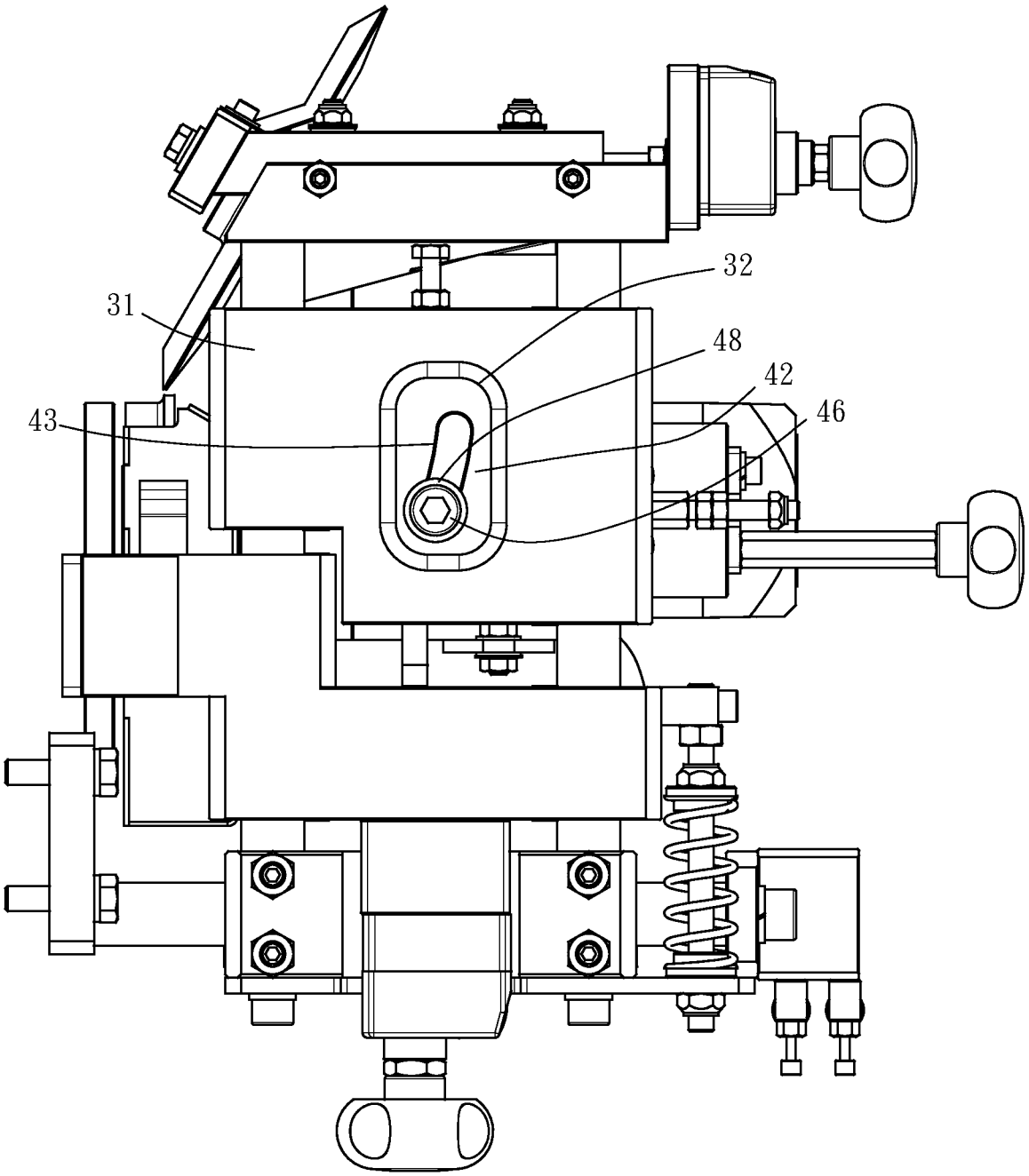
FIG. 6 is a left side view of the adjustable trimming mechanism of the present invention.
Figure 7:
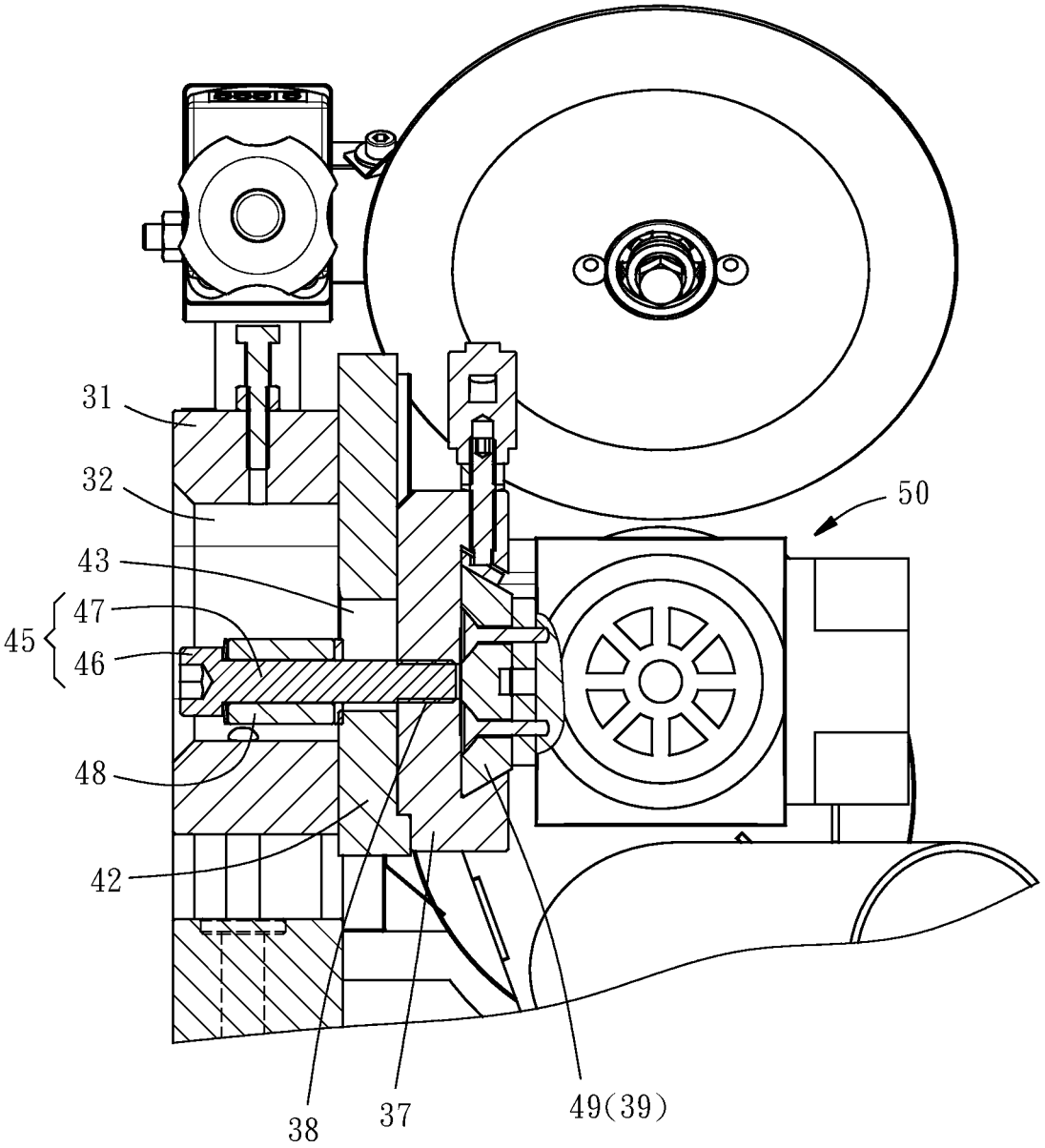
FIG. 7 is a partially sectional view of the adjustable trimming mechanism of the present invention.
Figure 8:
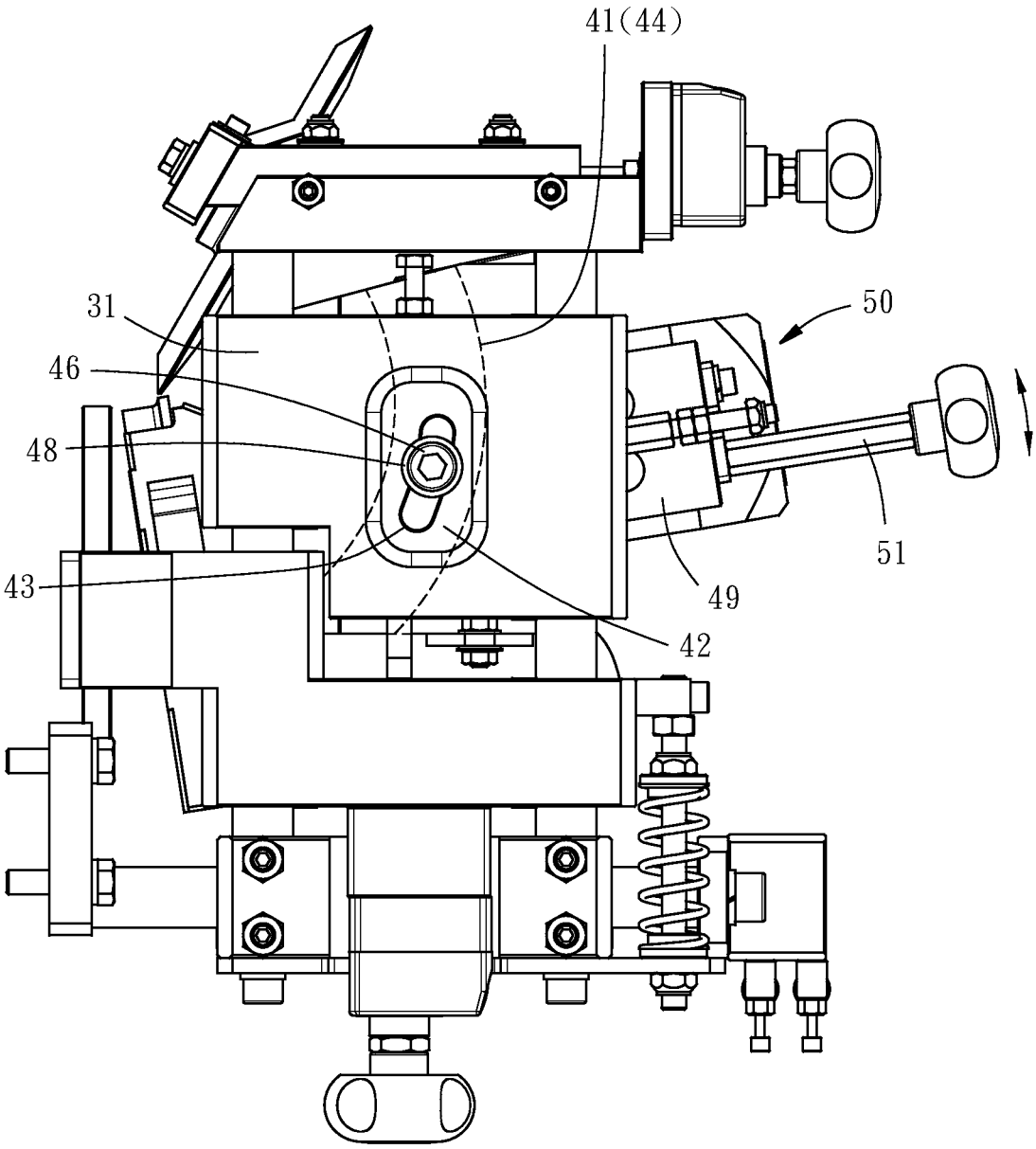
FIG. 8 is similar to FIG. 6, primarily showing the condition that a motor is deflectable upwardly and downwardly.

The slide rail 37 is provided on the left side thereof with a lateral threaded hole 38, as shown in FIG. 7. The slide rail 37 is provided on the right side thereof with a slide groove 39. The slide rail 37 further has a positioning threaded hole 40 extending from the top surface of the slide rail downwardly to communicate with the slide groove 39, as shown in FIG. 3. The slide rail 37 is abutted on the right side of a supporting seat 42. The supporting seat 42 is threadedly fixed on the right side of the motor mount 31 by members such as screws, and provided with an arc groove 43 as shown in FIG. 6. The motor mount 31 and the slide rail 37 are fixed to each other by an angle adjusting screw 45. Specifically speaking, the angle adjusting screw 45 has a head portion 46 and a body portion 47 connected with the head portion 46. As shown in FIG. 7, the head portion 46 of the angle adjusting screw 45 is located in the accommodating trough 32 of the motor mount 31. The body portion 47 of the angle adjusting screw 45 is inserted through the arc groove 43 of the supporting seat 42 and an end of the body portion is screwed into the lateral threaded hole 38 of the slide rail 37. Besides, a bushing 48 is sleeved onto the body portion 47 of the angle adjusting screw 45. An end of the bushing 48 is abutted against the head portion 46 of the angle adjusting screw 45. Another end of the bushing 48 is abutted against the left side of the supporting seat 42. In this way, when the angle adjusting screw 45 is loosened, as shown in FIG. 8, the slide rail 37 and the motor 50 are displaceable together upwardly and downwardly along the arc groove 43 relative to the motor mount 31. When the angle adjusting screw 45 is tightened, the angle adjusting screw 45 is abutted by the bushing 48 to limit the displacement of the slide rail 37, thereby positioning the slide rail 37. As shown in FIGS. 1, 4 and 8, the slide rail 37 is provided on the left side thereof with an arc guiding protrusion 41. The supporting seat 42 is provided on the right side thereof with an arc guiding recess 44. The arc guiding protrusion 41 of the slide rail 37 is displaceably embedded in the arc guiding recess 44 of the supporting seat for increasing the stability of the movement of the slide rail 37.

The slider 49 is disposed in the slide groove 39 of the slide rail 37 and displaceable frontward and backward along the slide groove 39.

The front end of the motor 50 is connected with a cutter 56 for providing power to the cutter. The motor 50 is located on the back of the wheel 25 and threadedly fixed on the right side of the slider 49 by fastening members such as screws, so that the motor 50 and the cutter 56 are displaceable together along with the slider 49.

An end of the pull rod 51 is threadedly fixed to the front end of the slider 49 by fastening members such as screws, so that when the pull rod 51 is applied with an external force, it can drive the slider 49 to displace frontward and backward.

The positioning member 52 has a handle 53 and a positioning screw 54. As shown in FIG. 3, the positioning screw 54 is screwed into the positioning threaded hole 40 of the slide rail 37. An end of the positioning screw 54 is connected with the handle 53 in a way that the positioning screw 54 can be driven by the handle 53 to make another end of the positioning screw abutted against the slider 49 indirectly through a spacer 55, thereby positioning the slider 49.

Figure 9:
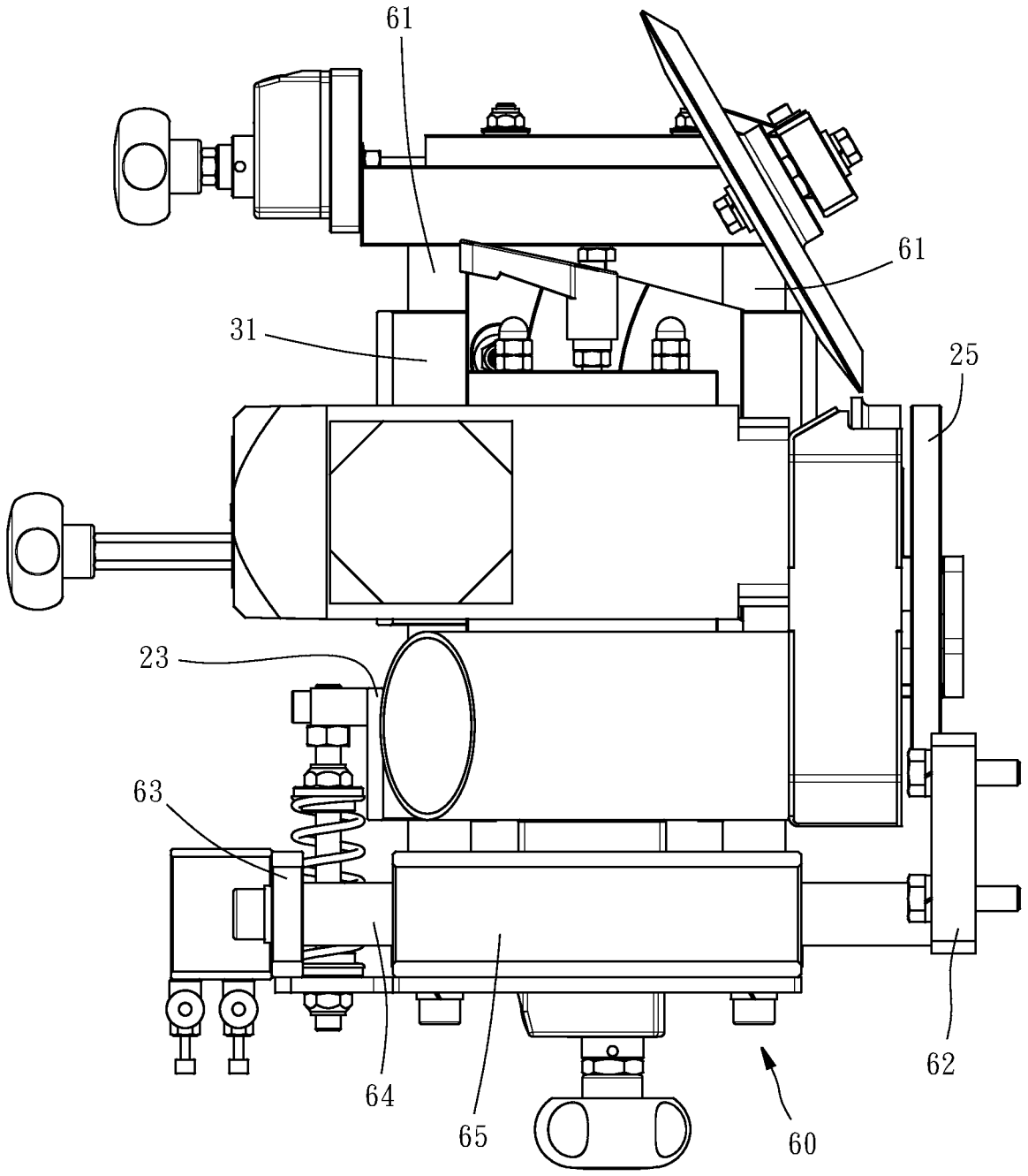
FIG. 9 is a right side view of the adjustable trimming mechanism of the present invention.
Figure 10:
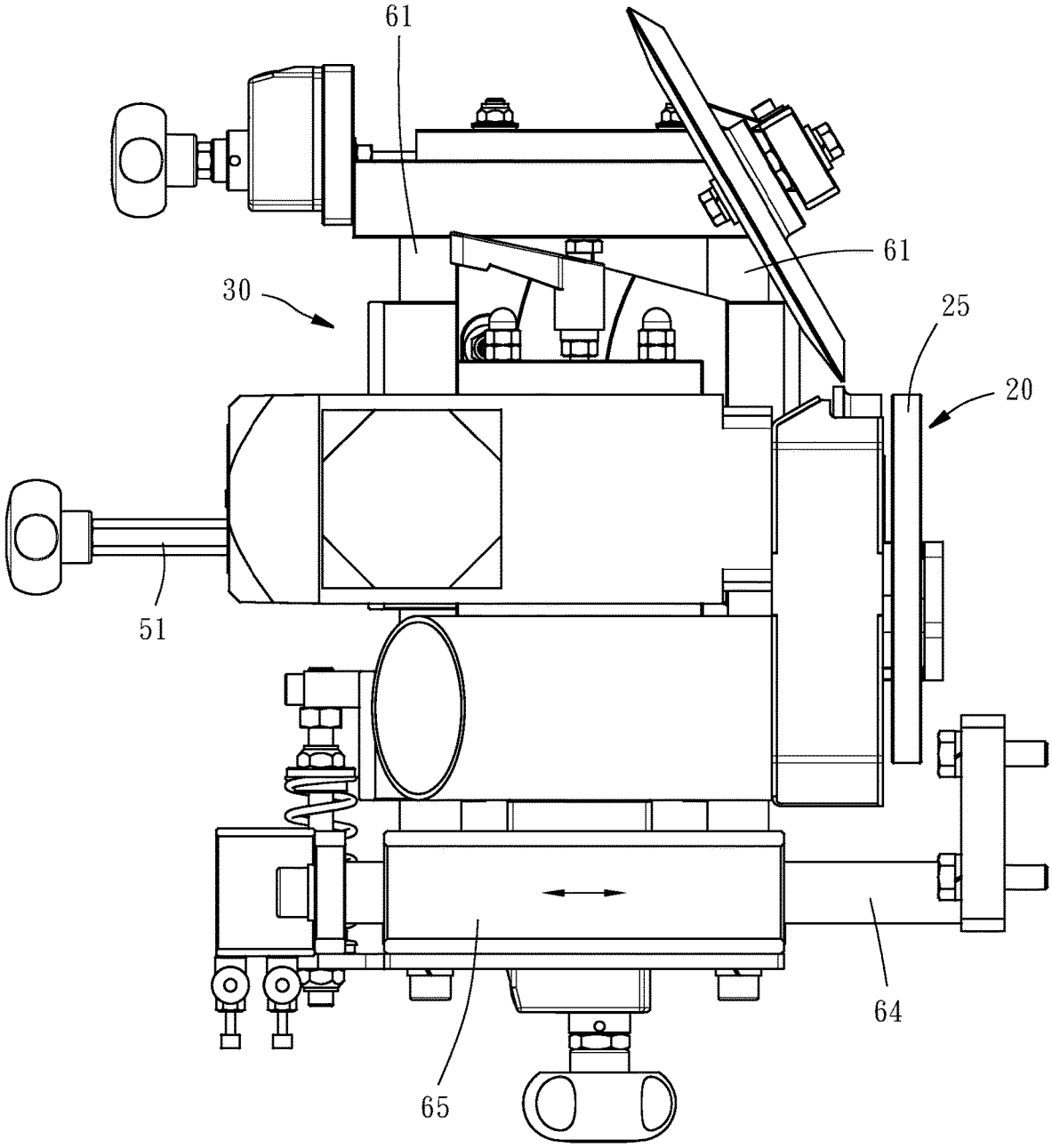
FIG. 10 is similar to FIG. 9, primarily showing the condition that a wheel module and the motor module are displaceable frontward and backward along horizontal guiding rods along with a guiding seat.

On the other hand, as shown in FIGS. 9-11, the present invention further provides a guiding unit 60. The guiding unit 60 has two vertical guiding rods 61, a front end seat 62, a rear end seat 63, two horizontal guiding rods 64 and a guiding seat 65. The two vertical guiding rods 61 are located by two opposite sides of the vertically adjusting screw 35 and penetrate through the motor mount 31 and the left plate 23 of the wheel mount 21 in a way that the motor mount 31 is displaceable along the axes of the vertical guiding rods 61. The front end seat 62 is fixed to a machine (not shown). The front end seat 62 and the wheel 25 are disposed in a way that one of them is located below the other of them. In this embodiment, the front end seat 62 is located below the wheel 25. The front and rear ends of the two horizontal guiding rods 64 are fixed to the front end seat 62 and the rear end seat 63 respectively by fastening members such as screws. The guiding seat 65 is disposed on the two horizontal guiding rods 64 and connected to the bottom ends of the two vertical guiding rods 61, so that the wheel module 20 and the motor module 30 are displaceable together frontward and backward along the axes of the two horizontal guiding rods 64 by being driven by the guiding seat 65 through the two vertical guiding rods 61.

Figure 5:
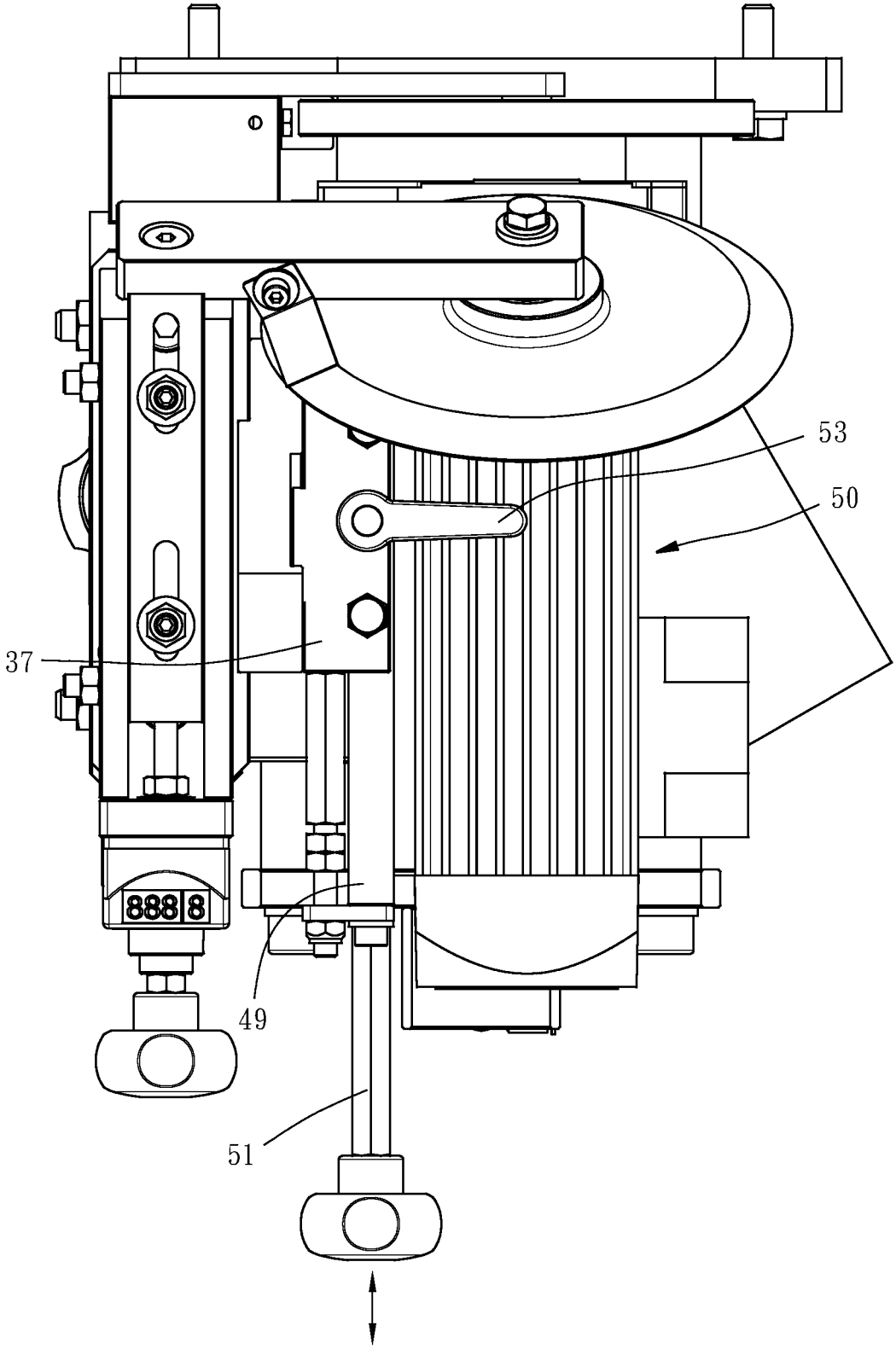
FIG. 5 is similar to FIG. 4, primarily showing the condition that a motor module is displaceable frontward and backward.

It can be known from the above description that when the positioning member 52 is tightened, as shown in FIGS. 9 and 10, the user can handle the pull rod 51 to make the wheel module 20 and the motor module 30 displace together frontward or backward along the axes of the two horizontal guiding rods 64 through the guiding seat 65, thereby adjusting the positions of the wheel 25 and the cutter 56 frontward or backward simultaneously. If the user wants to adjust the position of only the cutter 56 frontward or backward, as shown in FIGS. 4 and 5, the user firstly rotates the handle 53 to release the abutting force of the positioning screw 54 against the slider 49, and then handles the pull rod 51 to drive the slider 49 and the motor 50 to displace together frontward or backward, thereby adjusting the position of the cutter 56 installed on the motor 50 frontward or backward. After adjusting the cutter 56 to the appropriate position, the user tightens the positioning screw 54 through the handle 53, such that the positioning is accomplished.

When the user wants to adjust the angle of the cutter, as shown in FIGS. 6-8, the user firstly uses a hand tool such as a hexagonal wrench to loosen the angle adjusting screw 45 to release the abutting force of the bushing 48 against the supporting seat 42, and then handles the pull rod 51 to drive the slide rail 37, the slider 49 and the motor 50 to displace together upwardly or downwardly along the arc groove, thereby adjusting the angle of the cutter 56 installed on the motor 50. After adjusting the cutter 56 to the appropriate angle, the user tightens the angle adjusting screw 45 by the aforementioned hand tool, such that the positioning is accomplished.

In conclusion, the adjustable trimming mechanism 10 of the present invention can quickly and conveniently adjust the position of the cutter 56 frontward and backward, enabling the user to cut a straight angle or a chamfering on the workpiece according to the practical demands, and can further adjust the trimming angle of the cutter, thereby attaining the objectives of increasing usage convenience and raising economic benefits. Besides, when the adjustable trimming mechanism 10 of the present invention is practically in use, there may be two such mechanisms arranged one in front of the other along the direction the workpiece is conveyed. The front and rear mechanisms are installed in vertically reversed direction, such that the processing effect is even better.

What is claimed is:

1. An adjustable trimming mechanism comprising:

a wheel module having a wheel mount and a wheel disposed on the wheel mount; and a motor module having a motor mount, a slide rail, a motor, a slider, a pull rod, a positioning member and a cutter, the motor mount and the wheel mount being disposed in a way that one of them is located above the other of them, the slide rail being disposed on a side of the motor mount and having a positioning threaded hole, a side of the motor being connected with the slider, the slider being disposed on the slide rail in a way that the slider is horizontally displaceable relative to the slide rail, a front end of the motor being connected with the cutter for providing power to the cutter, an end of the slider being connected with the pull rod in a way that the slider is capable of being pulled by the pull rod to drive the motor to horizontally displace relative to the wheel, the positioning member having a handle and a positioning screw, the positioning screw being disposed in the positioning threaded hole of the slide rail and an end of the positioning screw being connected with the handle in a way that the positioning screw is capable of being driven by the handle to make another end of the positioning screw abutted against the slider and thereby positioning the slider, wherein the adjustable trimming mechanism further comprises a vertically adjusting member; the vertically adjusting member has a vertically adjusting screw and a knob connected to an end of the vertically adjusting screw; the wheel mount has a vertical through hole; the motor mount has an adjusting threaded hole; the vertically adjusting screw is inserted through the vertical through hole of the wheel mount in a way that the vertically adjusting screw is rotatable without displacing; another end of the vertically adjusting screw is screwed into the adjusting threaded hole of the motor mount in a way that the motor mount is capable of being driven by the vertically adjusting screw to vertically displace relative to the wheel mount.

2. The adjustable trimming mechanism as claimed in claim 1, wherein the adjustable trimming mechanism further comprises a guiding unit; the guiding unit has two vertical guiding rods located by two opposite sides of the vertically adjusting screw and penetrating through the motor mount and the wheel mount in a way that the motor mount is displaceable along axes of the vertical guiding rods.

3. The adjustable trimming mechanism as claimed in claim 2, wherein the guiding unit further has a front end seat, a rear end seat, two horizontal guiding rods and a guiding seat; the front end seat and the wheel are disposed in a way that one of them is located below the other of them; two ends of the two horizontal guiding rods are fixed to the front end seat and the rear end seat respectively; the guiding seat is disposed on the two horizontal guiding rods in a way that the guiding seat is horizontally displaceable relative to the two horizontal guiding rods; the guiding seat is connected to an end of the two vertical guiding rods in a way that the wheel module and the motor module are displaceable together along axes of the two horizontal guiding rods by being driven by the guiding seat through the two vertical guiding rods.

4. The adjustable trimming mechanism as claimed in claim 3, wherein the adjustable trimming mechanism further comprises an angle adjusting screw and a bushing; the motor mount has an accommodating trough; a supporting seat is disposed between the motor mount and the slide rail; the supporting seat has an arc groove; the slide rail has a lateral threaded hole; the angle adjusting screw has a head portion and a body portion connected with the head portion; the head portion is located in the accommodating trough; the body portion is inserted through the arc groove and an end of the body portion is screwed into the lateral threaded hole; the bushing is sleeved onto the body portion of the angle adjusting screw; an end of the bushing is abutted against the head portion of the angle adjusting screw; another end of the bushing is abutted against a side of the supporting seat facing toward the motor mount.

5. The adjustable trimming mechanism as claimed in claim 4, wherein the supporting seat is provided on a side thereof facing toward the slide rail with an arc guiding recess; the slide rail is provided on a side thereof facing toward the supporting seat with an arc guiding protrusion; the arc guiding protrusion of the slide rail is displaceably embedded in the arc guiding recess of the supporting seat.

6. The adjustable trimming mechanism as claimed in claim 2, wherein the adjustable trimming mechanism further comprises an angle adjusting screw and a bushing; the motor mount has an accommodating trough; a supporting seat is disposed between the motor mount and the slide rail; the supporting seat has an arc groove; the slide rail has a lateral threaded hole; the angle adjusting screw has a head portion and a body portion connected with the head portion; the head portion is located in the accommodating trough; the body portion is inserted through the arc groove and an end of the body portion is screwed into the lateral threaded hole; the bushing is sleeved onto the body portion of the angle adjusting screw; an end of the bushing is abutted against the head portion of the angle adjusting screw; another end of the bushing is abutted against a side of the supporting seat facing toward the motor mount.

7. The adjustable trimming mechanism as claimed in claim 6, wherein the supporting seat is provided on a side thereof facing toward the slide rail with an arc guiding recess; the slide rail is provided on a side thereof facing toward the supporting seat with an arc guiding protrusion; the arc guiding protrusion of the slide rail is displaceably embedded in the arc guiding recess of the supporting seat.

8. The adjustable trimming mechanism as claimed in claim 1, wherein the adjustable trimming mechanism further comprises an angle adjusting screw and a bushing; the motor mount has an accommodating trough; a supporting seat is disposed between the motor mount and the slide rail; the supporting seat has an arc groove; the slide rail has a lateral threaded hole; the angle adjusting screw has a head portion and a body portion connected with the head portion; the head portion is located in the accommodating trough; the body portion is inserted through the arc groove and an end of the body portion is screwed into the lateral threaded hole; the bushing is sleeved onto the body portion of the angle adjusting screw; an end of the bushing is abutted against the head portion of the angle adjusting screw; another end of the bushing is abutted against a side of the supporting seat facing toward the motor mount.

9. The adjustable trimming mechanism as claimed in claim 8, wherein the supporting seat is provided on a side thereof facing toward the slide rail with an arc guiding recess; the slide rail is provided on a side thereof facing toward the supporting seat with an arc guiding protrusion; the arc guiding protrusion of the slide rail is displaceably embedded in the arc guiding recess of the supporting seat.

10. An adjustable trimming mechanism comprising:

a wheel module having a wheel mount and a wheel disposed on the wheel mount; and a motor module having a motor mount, a slide rail, a motor, a slider, a pull rod, a positioning member and a cutter, the motor mount and the wheel mount being disposed in a way that one of them is located above the other of them, the slide rail being disposed on a side of the motor mount and having a positioning threaded hole, a side of the motor being connected with the slider, the slider being disposed on the slide rail in a way that the slider is horizontally displaceable relative to the slide rail, a front end of the motor being connected with the cutter for providing power to the cutter, an end of the slider being connected with the pull rod in a way that the slider is capable of being pulled by the pull rod to drive the motor to horizontally displace relative to the wheel, the positioning member having a handle and a positioning screw, the positioning screw being disposed in the positioning threaded hole of the slide rail and an end of the positioning screw being connected with the handle in a way that the positioning screw is capable of being driven by the handle to make another end of the positioning screw abutted against the slider and thereby positioning the slider, wherein the adjustable trimming mechanism further comprises an angle adjusting screw and a bushing; the motor mount has an accommodating trough; a supporting seat is disposed between the motor mount and the slide rail; the supporting seat has an arc groove; the slide rail has a lateral threaded hole; the angle adjusting screw has a head portion and a body portion connected with the head portion; the head portion is located in the accommodating trough; the body portion is inserted through the arc groove and an end of the body portion is screwed into the lateral threaded hole; the bushing is sleeved onto the body portion of the angle adjusting screw; an end of the bushing is abutted against the head portion of the angle adjusting screw; another end of the bushing is abutted against a side of the supporting seat facing toward the motor mount.

11. The adjustable trimming mechanism as claimed in claim 10, wherein the supporting seat is provided on a side thereof facing toward the slide rail with an arc guiding recess; the slide rail is provided on a side thereof facing toward the supporting seat with an arc guiding protrusion; the arc guiding protrusion of the slide rail is displaceably embedded in the arc guiding recess of the supporting seat.

* * * * *